US008006843B1

(12) United States Patent
McFarland

(10) Patent No.: US 8,006,843 B1
(45) Date of Patent: Aug. 30, 2011

(54) STACKABLE FOOD SERVICE TRAY AND COMBINATION

(75) Inventor: David Bruce McFarland, Attalla, AL (US)

(73) Assignee: Gadsen Coffee Co., Inc., Attalla, AL (US)

( * ) Notice: Subject to any disclaimer, the term of this patent is extended or adjusted under 35 U.S.C. 154(b) by 447 days.

(21) Appl. No.: 12/042,994

(22) Filed: Mar. 5, 2008

Related U.S. Application Data

(60) Provisional application No. 60/905,665, filed on Mar. 8, 2007.

(51) Int. Cl.
*B65D 21/00* (2006.01)
*B65D 1/34* (2006.01)
*B65D 6/04* (2006.01)

(52) U.S. Cl. ..... 206/511; 206/503; 206/512; 206/518; 206/519; 206/520; 206/565; D7/543; D7/550.1; D7/554.3

(58) Field of Classification Search ..... 206/503, 206/511, 512, 518, 519, 520, 565; D7/543, D7/550.1, 554.3
See application file for complete search history.

(56) References Cited

U.S. PATENT DOCUMENTS

| | | | | | |
|---|---|---|---|---|---|
| 1,440,070 | A | * | 12/1922 | Fry | 220/575 |
| 1,655,735 | A | * | 1/1928 | Meinecke | 294/172 |
| 2,878,932 | A | | 3/1959 | Martire | |
| 3,067,921 | A | * | 12/1962 | Reifers | 229/407 |
| 4,231,476 | A | * | 11/1980 | Compton et al. | 206/519 |
| D262,104 | S | | 12/1981 | Simpson | |
| 4,967,908 | A | * | 11/1990 | Kessler | 206/518 |
| 4,989,742 | A | * | 2/1991 | Powell | 220/23.4 |
| D316,210 | S | | 4/1991 | Giugiaro | |
| 5,678,694 | A | | 10/1997 | Tanaka et al. | |
| 5,758,773 | A | * | 6/1998 | Clements | 206/519 |
| D409,448 | S | * | 5/1999 | Hudson et al. | D7/543 |
| 6,010,005 | A | | 1/2000 | Reames et al. | |
| D451,347 | S | | 12/2001 | Kleckauskas et al. | |
| D483,216 | S | * | 12/2003 | Siegel et al. | D7/354 |
| 6,796,249 | B1 | | 9/2004 | Hiras | |
| 6,814,235 | B2 | | 11/2004 | Wang | |
| D526,851 | S | | 8/2006 | Groff et al. | |
| 2002/0000442 | A1 | | 1/2002 | Howard et al. | |
| 2003/0080014 | A1 | | 5/2003 | Ridgeway et al. | |
| 2007/0278126 | A1 | * | 12/2007 | Hatcher | 206/565 |

* cited by examiner

*Primary Examiner* — Anthony Stashick
*Assistant Examiner* — Madison L Wright
(74) *Attorney, Agent, or Firm* — Brian D. Smith, P.C.

(57) ABSTRACT

A stackable food and beverage service tray includes a substantially planar tray bottom and a sloping side wall extending upwardly and outwardly from an inner peripheral edge of the tray bottom so as to surround said tray bottom. The tray bottom has an upper floor surface and an underside surface. The tray's sloping side wall has an inner surface and an outer surface with the side wall's outer surface adjoining the tray's underside surface at a peripheral bottom edge of the tray. A raised rib is provided on the inner surface of the sloping side wall. Feet are also provided on the tray's underside surface along the bottom edge of the tray. The tray's raised rib and feet cooperate to define a space between stacked trays through which air can flow to facilitate drying of the stacked trays after they have been washed.

19 Claims, 5 Drawing Sheets

STACKABLE FOOD SERVICE TRAY AND COMBINATION

CROSS REFERENCE TO RELATED APPLICATIONS

This application is a nonprovisional application claiming the benefit under 35 USC 119(e) of U.S. provisional application Ser. No. 60/905,665 filed on Mar. 8, 2007.

FIELD OF THE INVENTION

This invention relates generally to trays for the food service industry, and more particularly, to stackable or nestable trays.

BACKGROUND OF THE INVENTION

Conventional food service trays typically have a substantially flat bottom portion on which a tread pattern is formed to reduce the likelihood of slippage of food while on the tray. These known trays are further provided with a peripheral rim or sloping side wall that surrounds the flat bottom portion, and a slight flange extending outward therefrom, in a direction substantially parallel to the planar bottom section. When being carried by a user, which may be restaurant personnel or a customer, the tray is handled in the region of the peripheral rim and the outwardly extending flange. In some known trays, the outwardly extending flange is extended somewhat to permit same to function as a handle, which improves the security with which the tray is handled.

In addition, standards have been developed by which trays that are used in the food service business are of predetermined dimensions and nest within one another so as to be stackable. After use, these trays are typically washed and then stacked so as to be ready for subsequent use. While stackable trays have been used, as indicated, for years, drying of stacked trays has been a problem because water or moisture is often trapped between the stacked trays, thereby preventing the trays from drying.

There is a need, therefore, for a stackable tray that will dry quickly and easily when stacked.

It is also an object of this invention to provide a tray and tray item combination that will resist sliding of the tray item, i.e. cup, bowl, plate, etc. on the floor of the tray, and thereby reduce the likelihood of food spillage during carriage of food and beverage by a tray user.

It is yet another object of this invention to provide a tray arrangement that can easily be easily gripped by a tray user.

It is yet another object of this invention to provide a tray that is easily accessible by a tray user who is in a reclined position such as a patient lying in a hospital bed.

SUMMARY OF THE INVENTION

The foregoing and other objects are achieved by this invention which provides a stackable food and beverage service tray including a substantially planar tray bottom and a sloping side wall extending upwardly and outwardly from an inner peripheral edge of said tray bottom so as to surround said tray bottom. The tray bottom has an upper floor surface (also referred to herein as a floor) and an underside surface which is generally flat. The tray's sloping side wall has an inner surface and an outer surface with the side wall's outer surface adjoining the tray's underside surface at a peripheral bottom edge of the tray. The side wall's inner surface adjoins the upper floor surface of the tray bottom at the aforesaid inner peripheral edge of the tray bottom.

In accordance with an important aspect of the present invention, a raised rib (sometimes referred to herein as a rail) is provided on the inner surface of the sloping side wall at a location which is adjacent the inner peripheral edge of the tray bottom. In addition, feet are provided on the tray's underside surface along the bottom edge of the tray. The tray is designed so that when stacked on another identical tray of the present invention, the tray's feet cooperate with the raised rib(s) of the tray upon which it is stacked so that the feet of the upper (or second tray) contact the rib(s) or rail of the lower (or first) tray to prevent the underside surface of the upper tray from making substantial contact with the upper surface or floor of the first tray. The feet and rib also cooperate to prevent the outer surface of the sloping side wall of the upper tray from making substantial contact with the inner surface of the side wall of the lower tray. As such, the stacked trays define a space between them through which air can flow to facilitate drying of the stacked trays after they have been washed.

Another preferred embodiment of the present invention provides a stackable food and beverage service tray having a substantially planar tray bottom and a sloping side wall as discussed above as well as opposing first and second openings in the sloping side wall of the tray. The openings are located on opposite sides of the tray and serve as handles for gripping the tray. In addition, the tray's sloping side wall further defines opposing first and second dams on opposite sides of the tray such that the first dam is located between the first opening and the inner peripheral edge of the tray bottom with the second dam being located between the second opening and the inner peripheral edge of the tray bottom. As will be appreciated and as indicated by the name provided for this feature of the present invention, the dams serve to contain liquids spilled on the tray floor.

Yet another preferred embodiment of the present invention provides a stackable food and beverage service tray having a substantially planar tray bottom and a sloping side wall as discussed above as well as an easily gripped bead extending along at least a portion of the sloping side wall's outer peripheral edge, i.e. the edge at which the sloping side wall terminates. Preferably, the bead has a generally oval shaped cross section and is disposed relative to the plane of the tray's bottom so that the longitudinal (or major) axis of the oval-shaped bead forms about a 45 degree included angle with the plane of the tray bottom.

Yet another preferred embodiment of the present invention provides a stackable food and beverage service tray having a substantially planar tray bottom and a sloping side wall as discussed above. However, in this embodiment of the present invention, the height of the sloping side wall on one side of the tray is less than it is on the other side of the tray. It has been found that such a tray, i.e. a tray having a shorter side wall on one side, is easier to access by a tray user who is in a reclined position such as a patient lying in a hospital bed.

In yet another preferred embodiment, the tray is generally rectangularly shaped and as such has four corners. However, in this embodiment, the height of the side wall at two adjacent corners of the tray's four corners is less than it is at the other two corners. These two adjacent corners having the shorter side wall, i.e. the shortened corners, are also preferably rounded and as such have been found to be particularly easy to grip.

The present invention also provides a stackable food and beverage service tray combination including a tray having a substantially planar tray bottom and a sloping side wall as discussed above. The floor or upper surface of the planar tray bottom of this embodiment is additionally provided with first surface features such as serpentine-shaped ribs and valleys.

This embodiment also includes at least one tray item such as a cup, bowl and/or plate which is provided with second surface features for engaging the first surface features of the tray to prevent the tray item from sliding on the tray floor. The surface features of the tray item are preferably bump-shaped protrusions.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
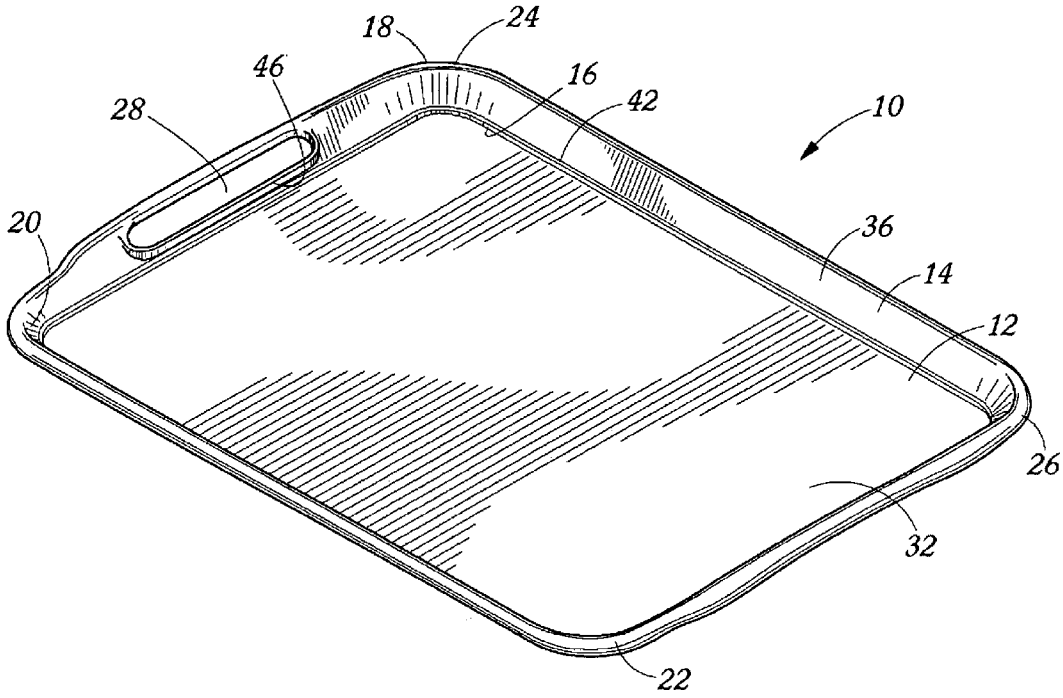
FIG. 1 is a perspective view of a food service tray of the present invention.
Figure 2:
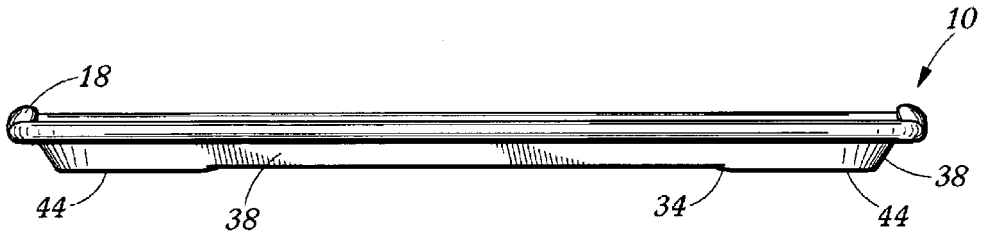
FIG. 2 is a front elevational view of the food service tray of FIG. 1.
Figure 3:
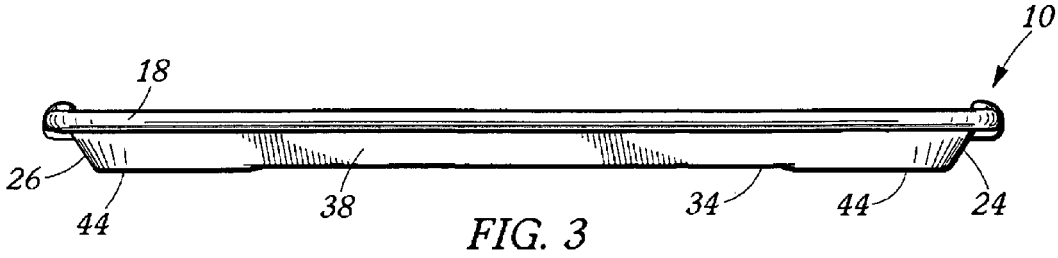
FIG. 3 is a rear elevational view of the food service tray of FIG. 1.

FIGS. 1-6 provide several views of a generally rectangularly shaped stackable food and beverage service tray 10 of the present invention which is preferably of unitary construction and injection molded. As shown, tray 10 has a substantially planar tray bottom 12 and a sloping side wall 14 which extends upwardly and outwardly from an inner peripheral edge 16 of the tray bottom until it terminates at an outer peripheral edge or bead 18. As also shown, the side wall 14 surrounds the tray bottom and forms the four rounded corners 20, 22, 24 and 26 of the tray as well as the opposing first and second openings 28, 30 on opposite sides of said tray which serve as handles (not numbered) for gripping the tray. As also shown in the figures, tray bottom 12 has an upper floor surface or floor 32 and an underside surface 34 (best shown in the bottom plan view of FIG. 6) which is generally flat. Side wall 14 has an inner surface 36 and an outer surface 38 with the outer surface 38 adjoining the tray's underside surface 34 at a peripheral bottom edge 40 of the tray. The side wall's inner surface 36 adjoins the floor 32 of the tray bottom at the aforesaid inner peripheral edge 16 of the tray bottom.

In accordance with an important aspect of the present invention, a raised rib or rail 42 is provided on the inner surface 36 of side wall 14 at a location which is adjacent the inner peripheral edge 16 of the tray bottom. In addition, feet 44 are provided on the tray's underside surface 34 along the bottom edge 40 of the tray.

Figure 7:
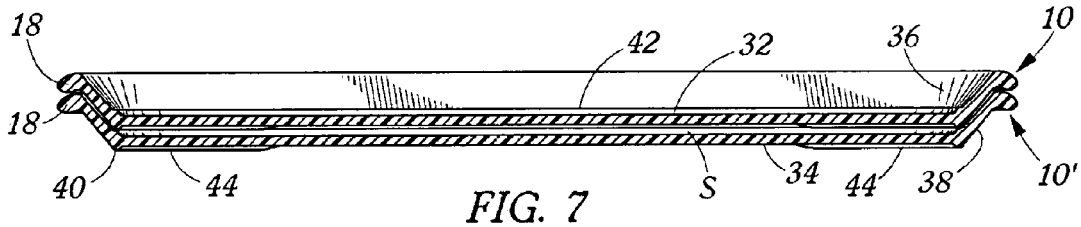
FIG. 7 is a cross sectional view taken along lines 7-7 of FIG. 5.
Figure 8:
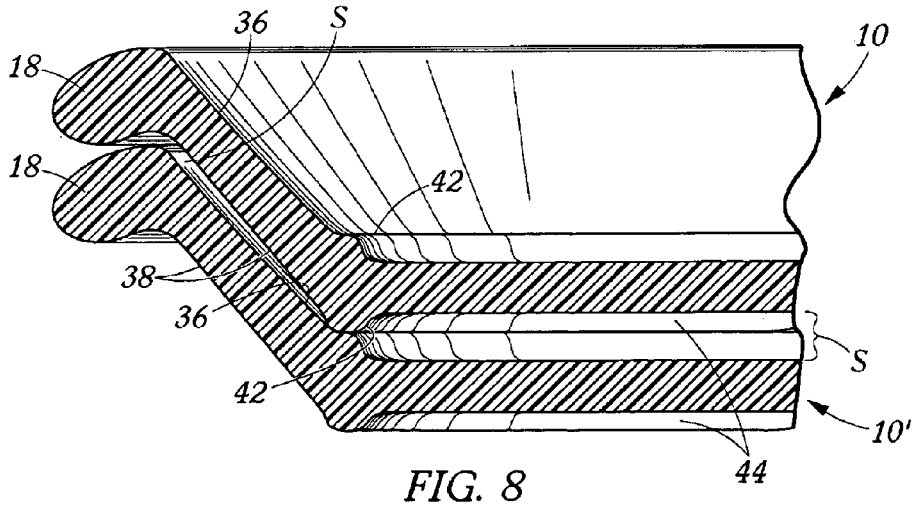
FIG. 8 is a cross sectional view taken along lines 8-8 of FIG. 5.
Figure 9:
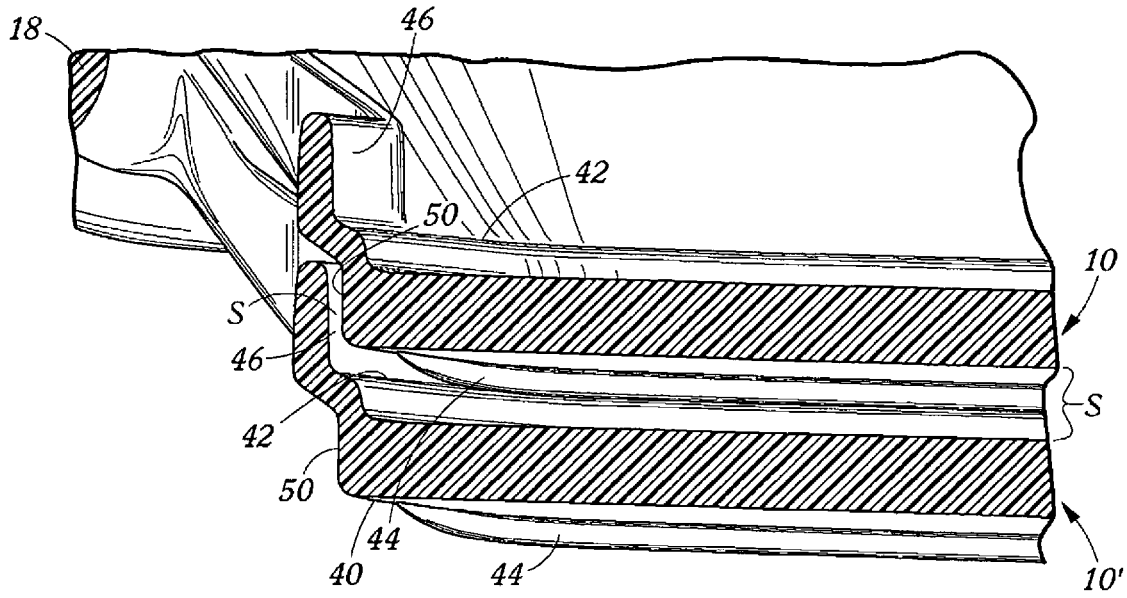
FIG. 9 is a cross sectional view taken along lines 9-9 of FIG. 5.

Tray 10 is designed so that when stacked on another identical tray 10' of the present invention as shown in FIGS. 7-9, the tray's feet 44 cooperate with the rail 42 of the lower tray 10' so that they contact rail 42 of the lower tray 10' to prevent the underside surface 34 of the upper tray 10 from making substantial contact with the upper floor surface 32 of the lower tray 10'. The feet and rib also cooperate, i.e. they are sized and configured, to prevent the outer surface 38 of the side wall of the upper tray 10 from making substantial contact with the inner surface 36 of the side wall of the lower tray 10'. As such and as best shown in FIGS. 8 and 9, the stacked trays 10, 10' define a space S between them through which air can flow to facilitate drying of the stacked trays after they have been washed.

In addition, since rail 42 is located above the tray's floor 32, those skilled in the art will appreciate that feet 44 of the upper tray 10 will not contact the floor 32 of the lower tray 10' when the trays are stacked. As such, water marks will rarely, if ever, be left on the trays' floors after the trays dry Those skilled in the art will also appreciate that tray 10 has been designed so that the tray's feet 44 cooperate with the inner surface 36 of the side wall of the lower tray 10' so that when a tray such as tray 10 is stacked on a on another identical tray such as tray 10', the inner surface 36 of the side wall of the lower tray automatically directs the feet 44 of the upper tray onto rail 42 of the lower tray, thereby centering the upper tray on the lower tray.

Figure 11:
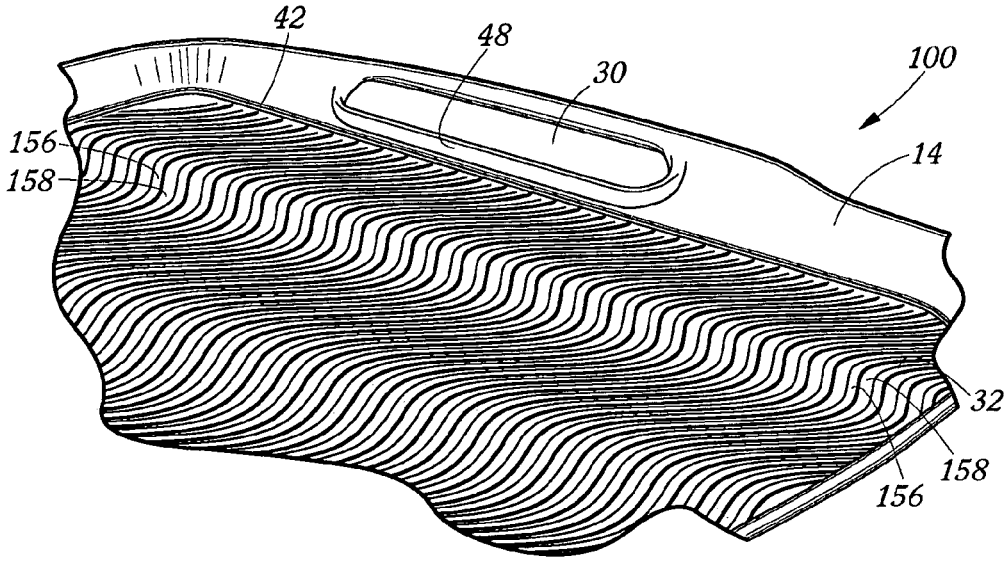
FIG. 11 is a partial perspective view of another food service tray of the present invention.

FIG. 1 also illustrates that the tray's side wall 14 defines a pair of opposing first and second dams 46, 48 on opposite sides of the tray which are located directly below the first and second handle openings 28, 30 and but above rail 42 and the inner peripheral edge 16 of the tray. As those skilled in the art will appreciate, dams 46, 48 serve to contain liquids and food spilled on the tray bottom by a user of the tray. An enlarged view of an identical dam 48 on another tray 100 of the present invention is shown in FIG. 11.

Figure 10:
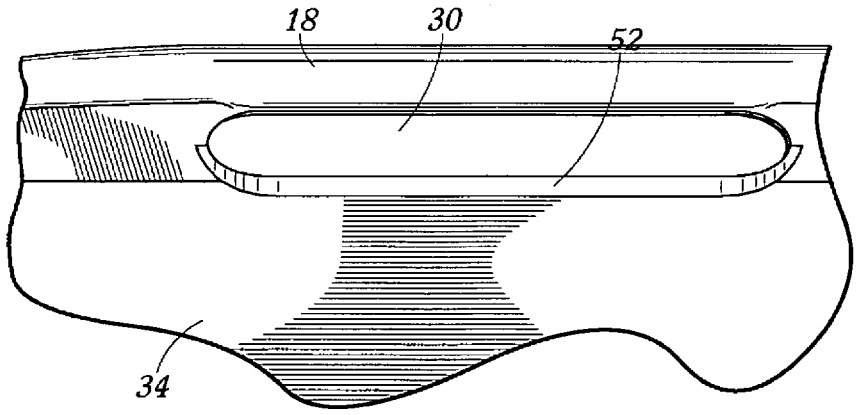
FIG. 10 is an enlarged partial view of the bottom plan view of FIG. 6.

FIGS. 9 and 10 further illustrate that the outer surface 38 of the tray's side wall 14 defines first and second dam receiving sections 50, 52 which receive first and second dams 46, 48 the lower tray 10' when trays 10 and 10' are stacked, as previously described. In addition, it will be appreciated that the dams and dam receiving sections are sized and configured so that they are prevented from making substantial contact with each other when the trays are stacked and, as shown, actually define a space (again identified by the letter S) between each other through which air can flow to facilitate the drying of the stacked trays 10 and 10' after they have been washed.

FIG. 8 which provides a cross-sectional view of stacked trays 10, 10' illustrates that the tray's aforementioned outer peripheral edge or bead 18 has a generally oval shaped cross section and is disposed relative to the plane of the tray's bottom so that the longitudinal (or major) axis of the oval-shaped bead forms about a 45 degree included angle with the plane of the tray bottom. This shape has been found to facilitate gripping of the tray, particularly by food service personnel who place the trays in slatted holding units for washing the trays and in handling the trays generally find it easier and quicker to simply grab the bead of the tray rather than the entire tray sidewall or handle.

Figure 4:
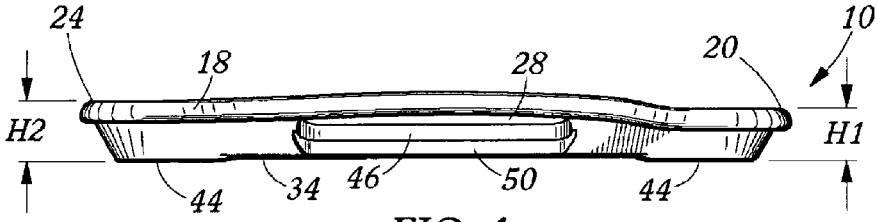
FIG. 4 is a left side elevational view of the food service tray of FIG. 1.
Figure 5:
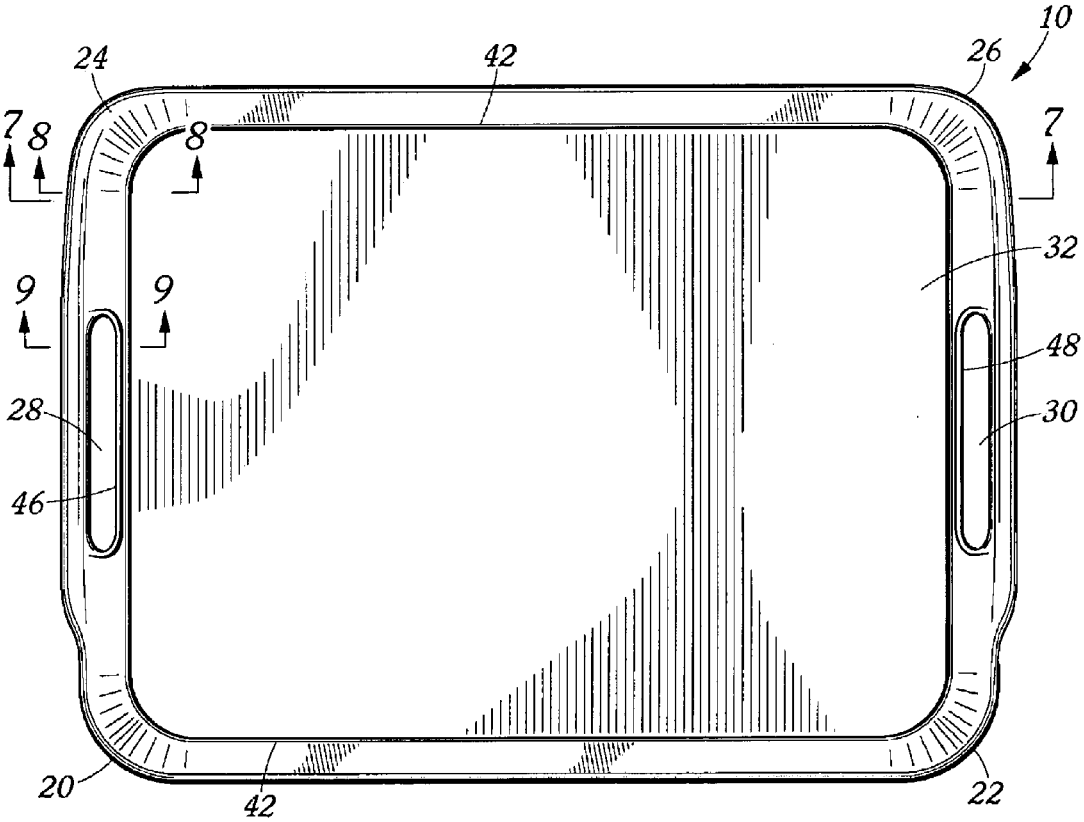
FIG. 5 is a top plan view of the food service tray of FIG. 1.
Figure 6:
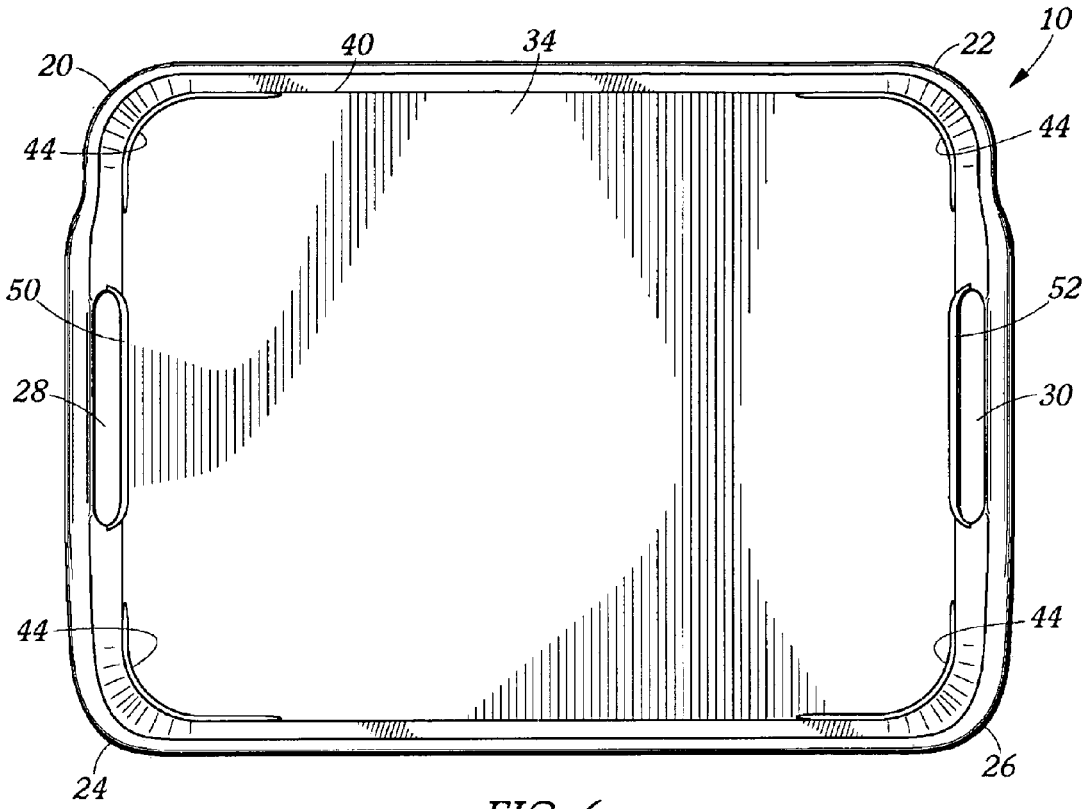
FIG. 6 is a bottom plan view of the food service tray of FIG. 1.

It will also be appreciated as shown in FIGS. 1-5 (best shown in FIG. 4) that the height of the side wall 14 on the side of the tray including corners 20, 22 is less than it is on the other side of the tray which includes corners 24, 26. It has been found that such a tray, i.e. a tray having a shorter side wall on one side, is easier to access by a tray user who is in a reclined position such as a patient lying in a hospital bed. It has also been found that the rounded corners 20, 22 having the shorter side wall are easier to grip than corners 24, 26. Rounded corners 20, 22 of the embodiment illustrated in FIGS. 1-10 have a height H1 as shown in FIG. 4 of 0.985 inches whereas the height H2 of corners 24, 26 is 1.175 inches.

Figure 12:
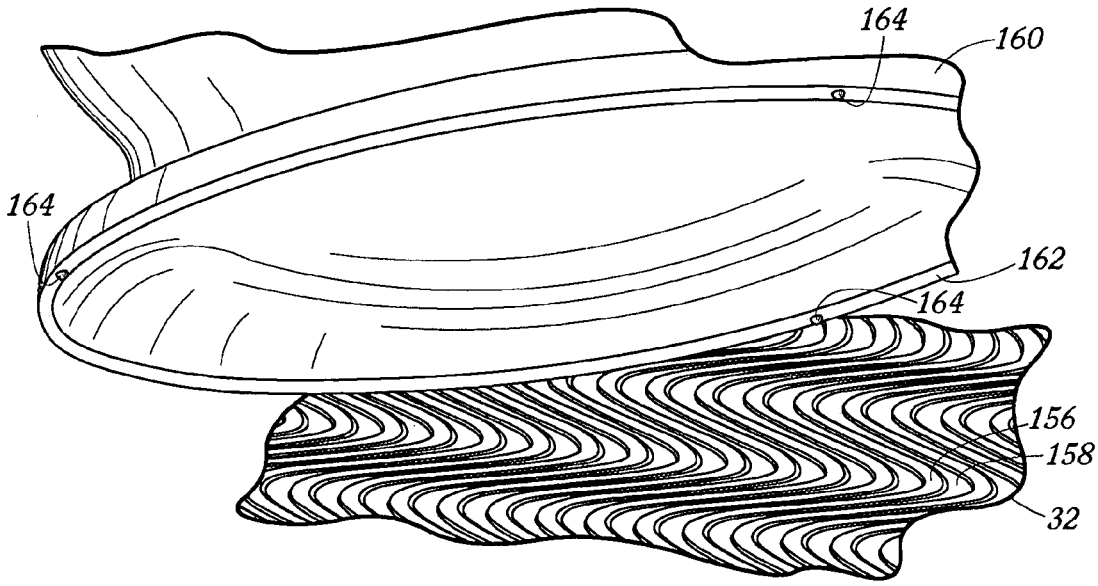
FIG. 12 is partial perspective view showing a section of the serpentine shaped floor of the tray of FIG. 11 as well as a cup having protrusions for engaging the serpentine valleys of the tray of FIG. 11.

FIGS. 11 and 12 illustrate another embodiment of the present invention which includes the combination of a stackable tray 100 and a cup 160. Tray 100 is identical to tray 10 and as such uses the same numerals to identify the tray's various parts. However, as shown in FIGS. 11 and 12, the floor 32 of the tray's planar bottom is additionally provided with serpentine-shaped raised ribs 156 and valleys 158. In addition, cup 160 is provided with a bottom rim 162 which is additionally provided with three bumps or protrusions 164. Bumps 164 are designed to fit within valleys 158 of the tray's floor 32 and thereby engage the valleys to prevent said cup from sliding on the floor. While FIG. 12 illustrates a cup, other common tray items such as bowls, plates and even silverware could be provided with engaging surface features such as bumps 164 for engaging the serpentine valleys 158 of the tray floor. Surface features other than the illustrated bumps 164 and serpentine valleys 158 are also considered to be within the scope of the present invention as long as they engage each other to prevent sliding of the tray item on the tray floor. However, the illustrated bumps 164 and serpentine valleys 158 are preferred and have been found to provide very good resistance to sliding even when a paper tray liner (not shown) is placed on the tray floor surface. It has been found that the cup's bumps 164 deflect the paper liner into the serpentine valleys 158 and as such provide the needed resistance or friction to prevent sliding of the cup on the paper liner supported by the tray floor.

Although the invention has been described in terms of specific embodiments and applications, persons skilled in the art can, in light of this teaching, generate additional embodiments without exceeding the scope or departing from the spirit of the disclosed invention. Accordingly, it is to be understood that the drawings and description in this disclosure are proffered to facilitate comprehension of the invention, and should not be construed to limit the scope thereof.

What is claimed is:

1. A stackable food and beverage service tray comprising:

a substantially planar tray bottom having an upper floor surface and an underside surface;

a sloping side wall extending upwardly and outwardly from an inner peripheral edge of said tray bottom so as to surround said tray bottom, said sloping side wall having an inner surface and an outer surface wherein said outer surface adjoins said underside surface at a peripheral bottom edge of said tray and said inner surface adjoins said upper floor surface of said tray bottom at said inner peripheral edge of said tray bottom, said sloping side wall further defining opposing first and second openings on opposite sides of said tray and wherein said openings serve as handles for gripping said tray, said sloping side wall further defining opposing first and second dams on opposite sides of said tray, said first dam being located between said first opening and said inner peripheral edge of said tray bottom, said second dam being located between said second opening and said inner peripheral edge of said tray bottom and wherein said dams serve to contain liquids spilled on said tray floor surface, said outer surface of said sloping side wall also defining first and second dam receiving sections so that when a second said tray is stacked on a first said tray said first and second dam receiving sections of said second tray receive said first and second dams of said first tray, said dams and dam receiving sections further being sized and configured so that they are prevented from substantial contact with each other when said first and second trays are stacked, said dams and dam receiving sections of stacked trays thereby defining a space between each other through which air can flow to further facilitate the drying of said stacked trays after they have been washed;

a raised rib on said inner surface of said side wall adjacent said inner peripheral edge of said tray bottom; and, feet provided on said underside surface along said bottom edge of said tray, said feet of a first said tray cooperating with said raised rib of a second said tray so that when a second said tray is stacked on a first said tray said feet of said second tray contact said rib of said first tray to prevent said underside surface of said second tray from substantial contact with said upper floor surface of said first tray, said feet and rib also cooperating to prevent said outer surface of said side wall of said second tray from substantial contact with said inner surface of said side wall of said first tray when said second tray is stacked on said first tray; so that said first and second stacked trays define a space between them through which air can flow to facilitate drying of said stacked trays after they have been washed.

2. A stackable food and beverage service tray as claimed in claim 1 wherein said feet of a second said tray cooperate with said inner surface of said side wall of a first said tray so that when a said second tray is stacked on a said first tray said inner surface of said side wall of said first tray automatically directs said feet of said second tray onto said rib of said first tray so that said second tray is centered on said first tray.

3. A stackable food and beverage service tray as claimed in claim 1 wherein said raised rib extends along said inner peripheral edge of said tray bottom.

4. A stackable food and beverage service tray as claimed in claim 1 wherein said tray is generally rectangularly shaped with four corners and wherein said feet are located along said bottom edge of said tray at each corner of said tray.

5. A stackable food and beverage service tray as claimed in claim 1 wherein said sloping side wall in the area defining said opposing first and second openings on opposite sides of said tray has a height which is greater than it is in any other area of said tray.

6. A stackable food and beverage service tray as claimed in claim 1 wherein said sloping side wall terminates at an outer peripheral edge which is shaped so as to form an easily gripped bead.

7. A stackable food and beverage service tray as claimed in claim 6 wherein said tray bottom lies in a plane and said bead has a generally oval shaped cross section with a longitudinal axis and wherein said bead disposed relative to the plane of said tray bottom so that the longitudinal axis of said oval-shaped bead forms a 45 degree included angle with said plane of said tray bottom.

8. A stackable food and beverage service tray as claimed in claim 6 wherein said bead extends around the entire outer peripheral edge of said sloping side wall of said tray.

9. A stackable food and beverage service tray as claimed in claim 1 wherein said upper floor surface of said planar tray bottom is provided with first surface features for engaging second surface features of tray items placed on said tray bottom to prevent said tray items from sliding on said tray bottom.

10. A stackable food and beverage service tray as claimed in claim 9 wherein said first surface features are serpentine-shaped ribs and valleys.

11. A stackable food and beverage service tray as claimed in claim 1 wherein said sloping side wall on one side of said tray has a height which is less than that on the opposite side of said tray.

12. A stackable food and beverage service tray as claimed in claim 1 which is injected molded and of unitary construction.

13. A stackable food and beverage service tray comprising:

a substantially planar tray bottom having an upper floor surface and an underside surface; and, a sloping side wall extending upwardly and outwardly from an inner peripheral edge of said tray bottom so as to surround said tray bottom, said sloping side wall having an inner surface and an outer surface wherein said outer surface adjoins said underside surface at a peripheral bottom edge of said tray and said inner surface adjoins said upper floor surface of said tray bottom at said inner peripheral edge of said tray bottom, said sloping side wall further defining opposing first and second openings on opposite sides of said tray, each said opening having a lower half extending toward said inner peripheral edge of said bottom tray and wherein said openings serve as handles for gripping said tray, said sloping side wall further defining opposing first and second dams on opposite sides of said tray, said first dam defining a first generally vertical inner surface which surrounds the lower half of said first opening and extends towards said inner peripheral edge of said tray bottom, said second dam defining a generally second vertical inner surface which surrounds the lower half of said second opening and extends towards said inner peripheral edge of said tray bottom and wherein said dams serve to contain liquids spilled on said tray floor surface.

14. A stackable food and beverage service tray as claimed in claim 13 wherein said outer surface of said sloping side wall also defines first and second dam receiving sections so that when a second said tray is stacked on a first said tray said first and second dam receiving sections of said second tray receive said first and second dams of said first tray, said dams and dam receiving sections further being sized and configured so that they are prevented from substantial contact with each other when said first and second trays are stacked, said dams and dam receiving sections of stacked trays thereby defining a space between each other through which air can flow to facilitate the drying of said stacked trays after they have been washed.

15. A stackable food and beverage service tray combination comprising:

a tray including a substantially planar tray bottom having an upper floor surface and an underside surface; said tray also including a sloping side wall extending upwardly and outwardly from an inner peripheral edge of said tray bottom so as to surround said tray bottom, said sloping side wall having an inner surface and an outer surface wherein said outer surface adjoins said underside surface at a peripheral bottom edge of said tray and said inner surface adjoins said upper floor surface of said tray bottom at said inner peripheral edge of said tray bottom, said upper floor surface of said planar tray bottom also being provided with first surface features; and, at least one tray item selected from the group consisting of cups, bowls, plates and silverware, said item being provided with second surface features including bump-shaped protrusions for engaging said first surface features of said tray floor surface to prevent said tray item from sliding on said tray floor surface.

16. A stackable food and beverage service tray combination as claimed in claim 15 wherein said first surface features are serpentine-shaped ribs and valleys.

17. A stackable food and beverage service tray as claimed in claim 15 wherein the height of said sloping side wall on one side of said tray is less than it is on the other side of said tray.

18. A stackable food and beverage service tray as claimed in claim 15 wherein said sloping side wall terminates at an outer peripheral edge which is shaped so as to form an easily gripped bead which extends around the entire outer peripheral edge of said sloping side wall of said tray.

19. A stackable food and beverage service tray as claimed in claim 18 wherein said bead has a generally oval shaped cross section which is disposed relative to the plane of said tray bottom so that the longitudinal axis of said oval-shaped bead forms about a 45 degree included angle with said plane of said tray bottom.

* * * * *